US007537032B2

(12) United States Patent
Stein

(10) Patent No.: US 7,537,032 B2
(45) **Date of Patent: *May 26, 2009**

(54) KEY LOCATOR

(75) Inventor: Sandra Stein, West Hills, CA (US)

(73) Assignee: Alexx, Inc., West Hills, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/977,891

(22) Filed: Oct. 26, 2007

(65) Prior Publication Data

US 2008/0086847 A1 Apr. 17, 2008

Related U.S. Application Data

(63) Continuation of application No. 10/919,494, filed on Aug. 17, 2004, now Pat. No. 7,308,922.

(51) Int. Cl.
*A45C 11/32* (2006.01)

(52) U.S. Cl. ..... 150/106; 150/104; 190/102; 24/3.6; 70/456 R; 70/459

(58) Field of Classification Search ..... 150/106, 150/104; 24/3.6; 70/456, 359, 456 R, 459; 63/1.1, 1.2, 12, 43; D3/207, 211; 190/102
See application file for complete search history.

(56) References Cited

U.S. PATENT DOCUMENTS

| | | | |
|---|---|---|---|
| 1,042,843 | A | 10/1912 | Toce |
| 1,106,388 | A | 8/1914 | Juergens |
| 1,165,882 | A | 12/1915 | Killion |
| 1,364,709 | A | 1/1921 | Butler |
| 1,418,979 | A | 6/1922 | Seferlis |
| 1,490,871 | A | 4/1924 | Wagner |
| 1,609,347 | A | 12/1926 | Dee |
| 2,117,989 | A | 5/1938 | Ryan |
| 2,218,932 | A | 10/1940 | Collins |
| 2,224,972 | A | 12/1940 | Long, Jr. et al. |
| 2,250,328 | A | 7/1941 | Daniels |
| D178,482 | S | 8/1956 | Bacon |

(Continued)

FOREIGN PATENT DOCUMENTS

| | | | |
|---|---|---|---|
| FR | 2606258 | A1 | 5/1988 |

(Continued)

OTHER PUBLICATIONS

U.S. Appl. No. 10/919,494, filed Aug. 17, 2004, Stein.

(Continued)

*Primary Examiner*—Sue A Weaver
(74) *Attorney, Agent, or Firm*—Jones Day; Brett Lovejoy

(57) ABSTRACT

A key locator includes first and second members. The first member has opposed ends and an intermediate u-shaped region. One of the ends of the first member comprises a hook for engaging the second member which includes a clasp while the other end comprises an enlarged portion for fixing an ornament thereto. The arrangement is suitable for hanging at the open top of a bag-like device such as a purse, backpack or briefcase whereby the ornament is displayed at the same time that the keys are readily accessible without undue fishing efforts.

17 Claims, 2 Drawing Sheets

U.S. PATENT DOCUMENTS

| | | | |
|---|---|---|---|
| 3,016,224 | A | 1/1962 | Hall |
| 3,071,938 | A | 1/1963 | Davidson |
| 3,670,524 | A | 6/1972 | Korwin |
| 3,707,742 | A | 1/1973 | Justice et al. |
| 3,934,317 | A | 1/1976 | Langwell |
| 4,004,325 | A | 1/1977 | Hubachek |
| 4,113,156 | A | 9/1978 | Brito |
| 4,201,259 | A | 5/1980 | Alsdorf |
| 4,221,118 | A | 9/1980 | Chicckine |
| 4,226,105 | A | 10/1980 | Wehrman |
| 4,282,733 | A | 8/1981 | Schmitt (Johnston) |
| D262,498 | S | 1/1982 | Beilis |
| 4,319,384 | A | 3/1982 | Horne |
| 4,407,148 | A | 10/1983 | Rousseau |
| 4,430,778 | A | 2/1984 | Sander |
| 4,516,418 | A | 5/1985 | Cuttler |
| 4,523,443 | A | 6/1985 | Momemers |
| 4,576,839 | A | 3/1986 | Parren |
| 4,587,818 | A | 5/1986 | Griffin |
| D285,989 | S | 10/1986 | MacDonald |
| D288,984 | S | 3/1987 | Scheurer et al. |
| 4,665,594 | A | 5/1987 | Wagner |
| D308,294 | S | 6/1990 | Krassner |
| D309,830 | S | 8/1990 | Kraus |
| D311,451 | S | 10/1990 | Chan |
| D312,172 | S | 11/1990 | Ambrosio |
| 4,976,124 | A | 12/1990 | Sanders |
| 5,048,310 | A | 9/1991 | Riley |
| 5,078,484 | A | 1/1992 | Vaughn |
| 5,173,999 | A | 12/1992 | Welk et al. |
| D341,940 | S | 12/1993 | MacDonald |
| 5,312,029 | A | 5/1994 | Tuber |
| D352,821 | S | 11/1994 | Stillwagon |
| 5,359,870 | A | 11/1994 | Reutlinger |
| D353,261 | S | 12/1994 | Fort et al. |
| D357,350 | S | 4/1995 | Stillwagon |
| D366,359 | S | 1/1996 | Riedl |
| D371,325 | S | 7/1996 | Fritsche |
| 5,535,797 | A | 7/1996 | Martindale |
| 5,551,269 | A | 9/1996 | Lewinstein et al. |
| D383,304 | S | 9/1997 | Van Osch |
| D385,415 | S | 10/1997 | Turbide |
| D392,201 | S | 3/1998 | Chen |
| D392,797 | S | 3/1998 | Kampe |
| 5,729,870 | A | 3/1998 | Sharp |
| 5,768,915 | A | 6/1998 | Crumrine et al. |
| D396,552 | S | 8/1998 | Browne |
| D398,775 | S | 9/1998 | Fritsche |
| D403,500 | S | 1/1999 | Winter |
| D403,501 | S | 1/1999 | Winter |
| D403,502 | S | 1/1999 | Winter |
| 5,983,686 | A | 11/1999 | Lee |
| D440,399 | S | 4/2001 | DeRouen et al. |
| D441,184 | S | 5/2001 | Haapala |
| 6,318,610 | B1 | 11/2001 | Doherty |
| 6,334,239 | B1 | 1/2002 | Kraut |
| D468,091 | S | 1/2003 | Tipton |
| 6,536,081 | B2 | 3/2003 | Allen et al. |
| 6,591,646 | B1 | 7/2003 | Huang |
| D478,719 | S | 8/2003 | Mercuri |
| 6,606,769 | B1 | 8/2003 | Harris |
| D479,768 | S | 9/2003 | Macevicz |
| D484,306 | S | 12/2003 | Lau |
| 6,772,614 | B1 | 8/2004 | Cheng |
| 6,843,086 | B2 | 1/2005 | Fitch |
| 6,870,483 | B1 | 3/2005 | Davis |
| D503,850 | S | 4/2005 | Staab |
| D504,222 | S | 4/2005 | Kieffer |
| 6,928,943 | B1 | 8/2005 | Neubauer |
| D510,185 | S | 10/2005 | Chan |
| 7,021,852 | B1 | 4/2006 | Turner, III et al. |
| 7,308,922 | B2 * | 12/2007 | Stein ..... 150/106 |
| 2003/0200687 | A1 | 10/2003 | Wolfe |
| 2003/0200779 | A1 | 10/2003 | Fitch |
| 2004/0020813 | A1 | 2/2004 | Moeller et al. |
| 2005/0208848 | A1 | 9/2005 | Grossman |
| 2005/0257867 | A1 | 11/2005 | Vazin |
| 2006/0048343 | A1 | 3/2006 | Sinon |
| 2006/0090302 | A1 | 5/2006 | Colby |
| 2006/0278311 | A1 * | 12/2006 | Mittelstaedt ..... 150/105 |

FOREIGN PATENT DOCUMENTS

| | | | |
|---|---|---|---|
| GB | 2180137 | A | 3/1987 |
| GB | 2274236 | A | 7/1994 |
| GB | 227 5173 | A | 8/1994 |
| JP | 2003 174913 | A | 6/2007 |

OTHER PUBLICATIONS

Mississippi Quarter from The United States Mint, issued 2002.
Office Action, dated Oct. 23, 2006, for U.S. Appl. No. 10/919,494.
Office Action, dated Sep. 10, 2007, for U.S. Appl. No. 10/919,494.
Office Aciton, dated Feb. 21, 2007, for U.S. Appl. No. 10/919,494.

* cited by examiner

FIG. 1A
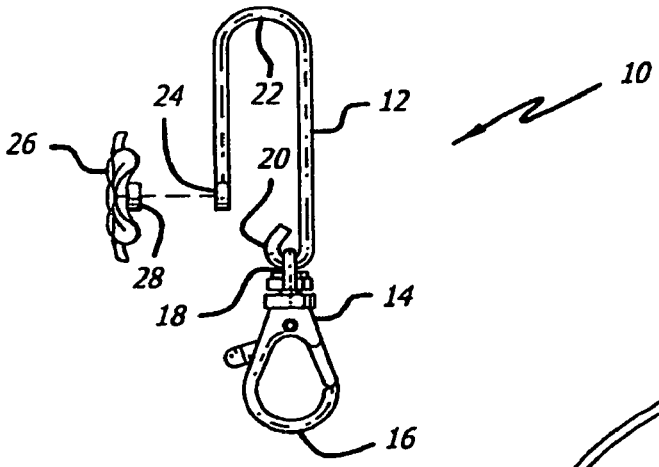
FIG. 1B
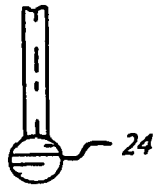
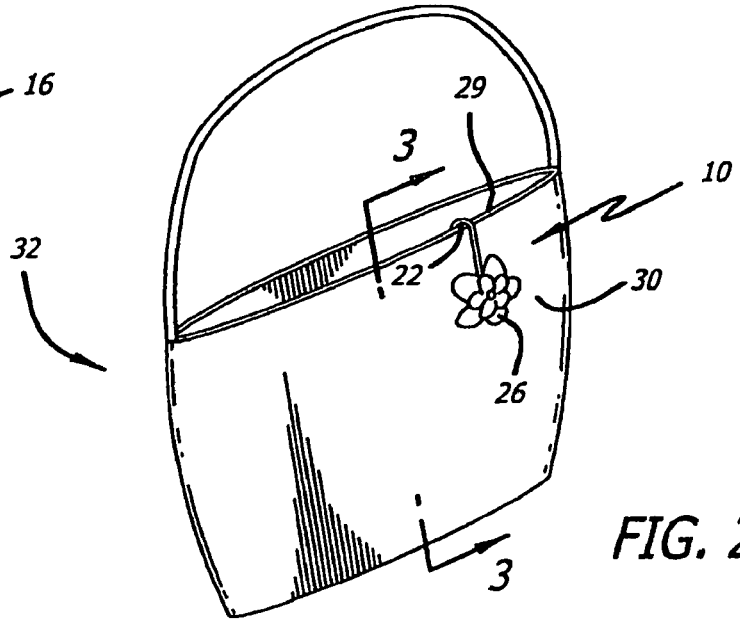
FIG. 2
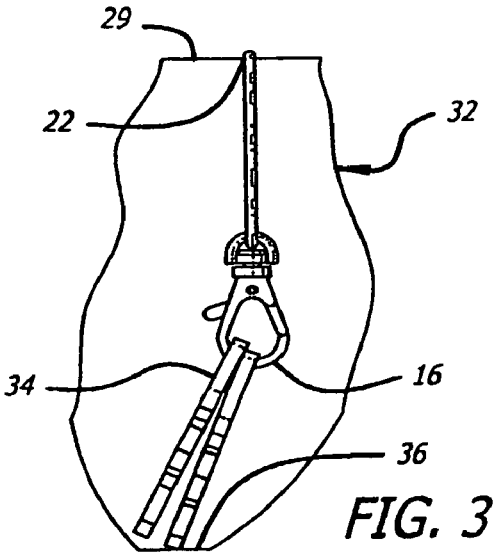
FIG. 3

KEY LOCATOR

CROSS REFERENCE TO RELATED APPLICATION

This application is a continuation application of U.S. patent application Ser. No. 10/919,494, filed on Aug. 17, 2004, now U.S. Pat. No. 7,308,922, the entire contents of which is hereby incorporated by reference herein.

BACKGROUND

1. Field of the Invention

The present invention relates to key holders. More particularly, this invention pertains to a key holder that is especially adapted to facilitate the ready location of keys in a purse, backpack, briefcase or like bag.

2. Brief Description of the Prior Art

A common and popular type of purse or like bag has a top that includes at least a region that is upwardly open in use. Often this type of bag is rather deep, permitting the owner-user to store a variety of items. Further, such depth is generally considered' fashionable. A known drawback of the above-described purse or like bag configuration resides in the difficulty of readily retrieving keys, or a group thereof gathered on a key chain, from'its interior. This can lead to the frustration of the owner-user and to others. For example, the difficulty of locating car keys at the bottom of a purse can cause significant delay in vacating a parking space.

SUMMARY OF THE INVENTION

The present invention addresses the preceding and other shortcomings of the prior art by providing a key locator. Such key locator includes a first member having opposed and portions.

The member incorporates a u-shaped region intermediate the end portions. A second member includes a clasp for selectively retaining at least one key. The first and second members are engaged to one another.

The preceding and other features of the invention will become further apparent from the detailed description that follows. Such description is accompanied by a set of drawing figures. Numerals of the drawing figures correspond to numerals of the written description with like numerals referring to like features throughout both the written description and the drawing figures.

BRIEF DESCRIPTION OF THE DRAWINGS

FIG. 2 is a perspective view of the key locator of the invention in use; and FIG. 3 is a cross-sectional view of the key locator of the invention in use taken at line 3-3 of FIG. 2.

DETAILED DESCRIPTION OF THE PREFERRED EMBODIMENT

Figure 1C:
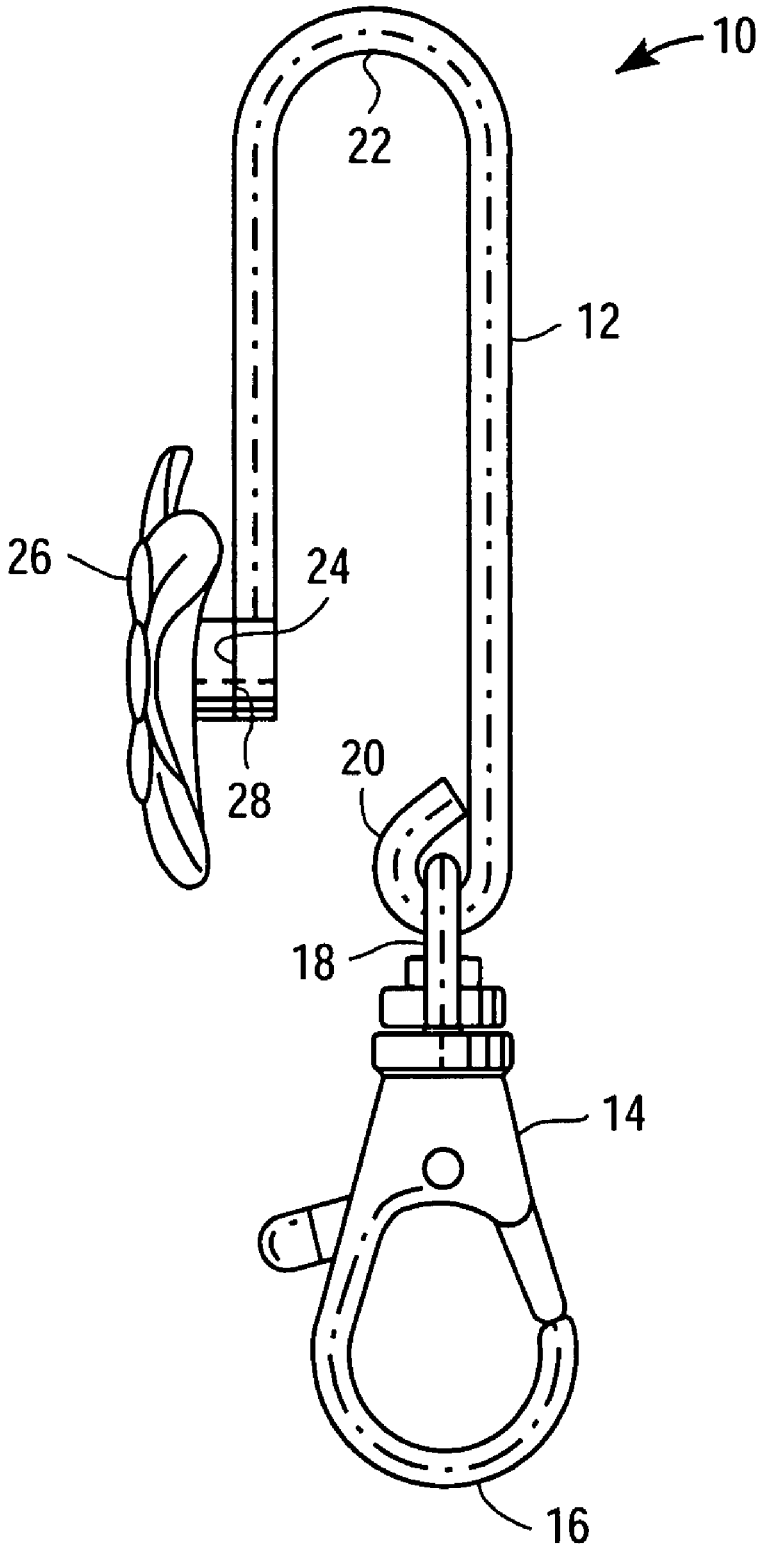
FIGS. 1(*a*) and 1(*b*) are a front elevation view of the key locator of the invention and a partial planar view of the ornament mounting pad thereof respectively, and FIG. 1(*c*) is a front elevation view of the key locator of the invention with the decorative element shown attached.

Turning now to the drawings, FIG. 1(*a*) is a front elevation view of the key locator 10 of the invention. The key locator 10 comprises interlocking first and second members 12 and 14 respectively. Each of the first and second members 12, 14 is preferably of steel or other metal although plastic or other rigid elastomeric material may be employed.

The second member 14 includes a clasp 16 that is preferably rotatably engaged to an inverted u-shaped element 18. The u-shaped element 18 is arranged to engage a hook 20 at one end of the first member 12 to provide flexible engagement of the members 12 and 14.

The first member 12 includes a u-shaped interior region 22. Its opposed end, as shown clearly in FIG. 1(*b*), comprises an enlarged region 24 that serves as an ornament mounting pad for affixation of a decorative ornament 26. The ornament 26, comprising a flower-like shape as shown in the drawings but not. limited thereto, is arranged to face away from the interior of the first member 12 with its back portion 28 preferably fixed to the enlarged region 24 of the member by solder or the like.

FIG. 2 is a perspective view of the key locator 10 of the invention in use. In FIG. 2, the key locator 10 is hung from the upper edge 29 of a side panel 30 of a bag-like purse 32 with the u-shaped region 22 overhanging the side panel 30 so that the face of the ornament 26 is exposed. This provides the user with an attractive adjunct to the purse 32 that serves the additional function of readily locating the key locator 10.

FIG. 3 is a cross-sectional view of the key locator of the invention in use taken at line 3-3 of FIG. 2. Keys 34, secured by the clasp 16 of the second member 14, are seen to lie near or at the bottom 36 of the bag-like purse 32, somewhat suspended from the upper edge 29 of the side panel 30. The u-shaped interior region 22 of the first member 12 of the key locator 10, as mentioned with reference to the preceding figure, is draped or hung over the upper edge 29 to create the suspension effect. The altitude of the bottom of the key locator 10 and keys 34 will depend upon the length of the key locator 10 relative to the depth of the side panel 30 of the bag-like purse 32. However, regardless of the precise altitude of the keys 34 within the purse 32, they may be readily located due to the visible presence of the ornament 26.

Thus, it can be seen that the present invention provides a key locator especially suitable for use with a purse, backpack, briefcase or other bag-like device. By employing the key locator of the invention in conjunction with such a device, one may find keys stored within without delay. Further, by providing a decorative ornament for indicating the location of the key locator, the appearance of the bag is enhanced.

While this invention has been described with reference to its. presently preferred embodiment, it is not limited thereto. Rather the invention is limited only insofar as it is defined by the following set of patent claims and includes within its scope all equivalents thereof.

What is claimed is:

1. A key locator comprising, in combination:

a) a bent rod-shaped first member having a first end portion and a second end portion; and b) a second member including a clasp for selectively retaining at least one key; wherein said first end portion and said second end portion are opposed to each other;

said bent rod-shaped first member incorporates a u-shaped region intermediate said first end portion and said second portion;

said first end portion and said second end portion are not urged against each other and are configured to allow said u-shaped region to hang from an edge;

said first end portion of said bent rod-shaped first member is configured for substantially permanently and flexibly engaging with the second member; and said clasp is rotatably fixed to a u-shaped element of said second member, wherein the u-shaped element is substantially permanently and flexibly engaged to said first end portion of said bent rod-shaped first member.

2. A key locator as defined in claim 1 further including an ornament directly and permanently fixed to said second end portion of said bent rod-shaped first member so that a first face of the ornament is exposed and so that the ornament is arranged to face away from an interior of said bent rod-shaped first member, wherein the ornament provides the function of readily locating the key locator on said edge and wherein the ornament provides the function of an attractive adjunct.

3. A key locator as defined in claim 2 wherein said second end portion of said bent rod-shaped first member comprises an enlarged portion for affixation of said ornament.

4. A key locator as defined in claim 3 wherein said ornament comprises a flower shape.

5. A key locator as defined in claim 3 wherein a back portion of said ornament is soldered onto said enlarged portion.

6. The key locator as defined in claim 1 wherein said bent rod-shaped first member and said second member are each made of a material selected from the group consisting of metal, steel, and plastic.

7. A key locator as defined in claim 1, wherein the edge is an upper edge of a side panel of a bag-like purse.

8. A key locator as defined in claim 7, wherein the bag-like purse is a purse, a backpack, or a briefcase.

9. A key locator as defined in claim 1, wherein said bent rod-shaped first member and said second member are configured so that when the bent rod-shaped first member is retrieved from the edge, the second member is necessarily retrieved.

10. A two-member apparatus comprising a bent rod-shaped first member and a second member, wherein (i) said bent rod-shaped first member has a first end portion and a second end portion, wherein said first end portion and said second end portion are opposed to each other;

(ii) said bent rod-shaped first member incorporates a u-shaped region intermediate said first end portion and said second end portion wherein said first end portion and said second end portion are not urged against each other and are configured to allow said u-shaped region to hang from an edge;

(iii) said first end portion of said bent rod-shaped first member is configured for substantially permanently and flexibly engaging with said second member and (iv) an ornament is directly and permanently fixed to said second end portion so that a face of the ornament is exposed and wherein the ornament provides the function of readily locating the two-member apparatus on the edge and wherein the ornament provides the function of serving as an attractive adjunct; and wherein said second member comprises a clasp that is rotatably fixed to a u-shaped element and wherein said u-shaped element engages said first end portion of said bent rod-shaped first member, wherein the clasp is configured for selectively holding keys.

11. The two-member apparatus of claim 10, wherein said ornament comprises a flower shape.

12. The two-member apparatus of claim 10, wherein a back portion of said ornament is soldered onto said second end portion.

13. The two-member apparatus of claim 10, wherein said bent rod-shaped first member and said second member are each made of a material selected from the group consisting of metal, steel, and plastic.

14. A two-member apparatus as defined in claim 10, wherein the edge is an upper edge of a side panel of a bag-like purse.

15. A two-member apparatus as defined in claim 14, wherein the bag-like purse is a purse, a backpack, or a briefcase.

16. A two-member apparatus as defined in claim 10, wherein said bent rod-shaped first member and said second member are configured so that when the bent rod-shaped first member is retrieved from the edge, the second member is necessarily retrieved.

17. A method comprising:

a) retaining at least one key by a clasp of a second member of an apparatus that comprises at least said second member and a bent rod-shaped first member, wherein (i) said bent rod-shaped first member of said apparatus has a first end portion and a second end portion, wherein said first end portion and said second end portion are opposed to each other, (ii) said bent rod-shaped first member incorporates a u-shaped region intermediate said first end portion and said second end portion, wherein said first end portion and said second end portion are not urged against each other and are configured to allow said u-shaped region to hang from an upper edge of a side panel of a bag-like purse, (iii) said first end portion of said bent rod-shaped first member is configured to substantially permanently and flexibly engage with said second member and (iv) said second end portion of said bent rod-shaped first member comprises an enlarged solid portion for affixation of an ornament that localizes the apparatus on the upper edge and serves as an attractive adjunct; and b) hanging the apparatus from said upper edge of said side panel of said bag-like purse with the u-shaped region overhanging the side panel so that said second end portion is exposed; and c) retrieving said bent rod-shaped first member of said apparatus from said upper edge such that, when said bent rod-shaped first member is retrieved from the upper edge, the at least one key retrained by the clasp of the second member is necessarily retrieved.

* * * * *

UNITED STATES PATENT AND TRADEMARK OFFICE

CERTIFICATE OF CORRECTION

PATENT NO. : 7,537,032 B2
APPLICATION NO. : 11/977891
DATED : May 26, 2009
INVENTOR(S) : Sandra Stein It is certified that error appears in the above-identified patent and that said Letters Patent is hereby corrected as shown below:

Column 4, line 53, please replace "retrained" with --retained--

Signed and Sealed this

Twenty-fifth Day of August, 2009

David J. Kappos

David J. Kappos
*Director of the United States Patent and Trademark Office*